United States Patent [19]

Lanier

[11] 4,279,288

[45] Jul. 21, 1981

[54] ADJUSTABLE FRAME APPARATUS

[76] Inventor: George G. Lanier, 26 Butler St., Rome, Ga. 30161

[21] Appl. No.: 43,342

[22] Filed: May 29, 1979

[51] Int. Cl.[3] ..... E06B 9/06

[52] U.S. Cl. ..... 160/374; 160/377

[58] Field of Search ..... 160/374, 377

[56] References Cited

U.S. PATENT DOCUMENTS

| | | | |
|---|---|---|---|
| 1,137,702 | 4/1915 | Crawford | 160/377 |
| 1,472,069 | 10/1923 | Helgeson | 160/374 |
| 2,183,331 | 12/1939 | Farmer | 160/374 |

*Primary Examiner*—Kenneth Downey

*Attorney, Agent, or Firm*—Jones, Thomas & Askew

[57] ABSTRACT

Storm window frame apparatus adjustable to fit various sizes of windows. The frame apparatus includes mitered right angle frame components that are hinged for easy assembly without tools. Frame members fit telescopiedly within each other for adjustability.

3 Claims, 4 Drawing Figures

ADJUSTABLE FRAME APPARATUS

BACKGROUND OF INVENTION

This invention relates in general to adjustable frame apparatus, and in particular to an adjustable frame for providing storm window or screen protection to an existing window or similar opening.

The use of auxiliary windows, such as storm windows, to fit over existing windows is well known, especially in household applications. If properly designed and fitted, storm windows provide a substantially airtight seal around the existing window and sash, and thereby reduce the amount of heat loss or heat gain that otherwise may occur through the existing window sash. This reduction in heat transfer takes place because the storm window effectively seals air leaks that are present between the fixed and moving parts of an existing window frame, and because the volume of air enclosed between the existing window and the storm window defines a dead air space which itself provides a insulating function.

Storm windows of the prior art have generally been custom manufactured for window frames of various standard sizes, and sometimes include slidable screen panels as well as window panes for storm window use. Such custom storm windows are relatively expensive to manufacture, and generally cannot be modified or tailored by the installer to fit windows of nonstandard configuration or dimension. The capital cost of equiping an entire home with custom storm windows of the prior art may be prohibitive and difficult to justify in many applications, moreover, even though savings in energy costs to heat or air-condition the home can be anticipated once the storm windows are in place. There is, accordingly, a need for a relatively inexpensive storm window that provides the energy-saving and comfort benefits of existing storm window structure, without the attendant expense of the conventional custom storm window.

Prior art attempts have been made to provide relatively inexpensive storm window structure which could be purchased by the individual home owner and installed as a do-it-yourself project, thereby eliminating the installation cost as well as a portion of the purchase cost associated with custom storm windows. These prior art structures have been less than satisfactory, however, for a number of reasons. Since the windows found in a typical house usually have a variety of overall frame dimensions, it becomes necessary for the retailer either to stock storm windows of many different sizes, or to carry storm window frame sections that the homeowner can cut as necessary to fit his particular windows. The cut-and-fit storm window structure of the prior art have been less than satisfactory, however, because many homeowners lack the skills and/or the tools necessary to provide a "custom-fit" or factory-built appearance to their cut-and-fit efforts. The lack of a custom appearance is especially evident at the corners of the typical rectangular storm window, where the absence of an accurate 45° miter joint greatly detracts from the overall appearance of an installed storm window.

SUMMARY OF INVENTION

The present invention overcomes the foregoing and other problems associated with the prior art by providing a frame apparatus that is adjustable to fit over windows of different sizes without requiring cutting or other fabricating operations by the installer. Stated in general terms, the adjustable frame of the present invention comprises prefabricated right-angle frame assemblies that are adjustably interconnectable, and further comprises a number of frame members that are individually connectable with certain ones of the right-angle frame assemblies. Stated somewhat more particularly, each of the frame assemblies and frame members telescopically interconnects with one or more other members, so that the effective overall external configuration of the frame apparatus is independently adjustable in both length and width. Stated even more particularly, each of the frame assemblies forming a right-angle joint can be folded for ease of pre-assembly shipping and storage. The individual frame members telescopically fit within members of separate frame assemblies, and have confronting preformed mitered ends so that the resulting assembled frame apparatus provides a finished professional appearance. The adjustable frame apparatus, once installed, is covered with a web of suitable material, such as sheet plastic, screening, or the like.

DETAILED DESCRIPTION OF PREFERRED EMBODIMENT

Figure 1:
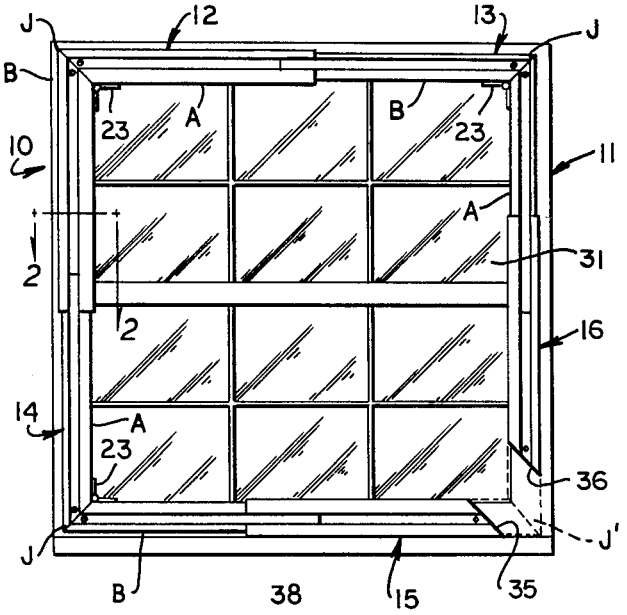
FIG. 1 shows an overall elevation view of an adjustable storm window frame apparatus according to a disclosed embodiment of the present invention, as the frame apparatus would be installed on the outside of an existing window sash.

Turning first to FIG. 1, there is seen generally at 10 a storm window frame according to an embodiment of the present invention. The window frame 10 is shown mounted in position over an existing sash window 11, although it should be understood that the storm window frame 10 and other window frames according to the present invention are equally usable with other types of existing windows, both rectangular and nonrectangular in shape, and whether or not of conventional sash construction.

The storm window frame 10 is made up of separate frame assemblies 12, 13, and 14, and two separate frame members 15 and 16. Each of the frame assemblies 12–14 includes a first frame component A and a second frame component B, with each of the two frame components joined together at an end so as to define a right-angle joint J, one example of which is shown in detail at FIG. 3.

Each of the joints J is preferably formed by beveled ends 20 and 21 at confronting ends of the two frame components A and B, respectively, and it should be understood that the ends 20 and 21 are preferably beveled at a 45° angle in the case of a rectangular storm window frame 10. Holes 22 may be formed in each frame component adjacent the beveled ends thereof, for securing the frame components in place relative to the frame of the existing window 11, as is explained below.

Figure 3:
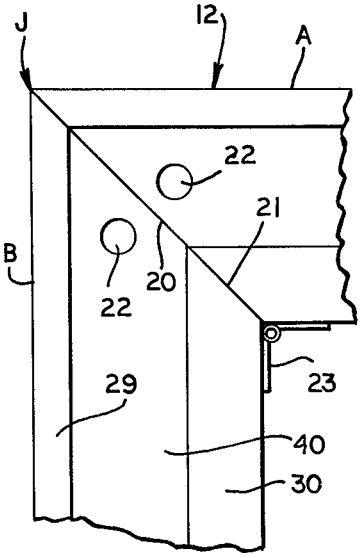
FIG. 3 is a fragmentary detail view showing a mitered corner joint in one of the frame assemblies used in the disclosed embodiment.

The frame components A and B which make up each of the frame assemblies 12–14 are preferably interconnected at the joint J by a hinge interconnection 23, which permits the frame components to be folded from the operative position with beveled ends 20 and 21 abutting each other (as seen in FIGS. 1 and 3), to a stowed position (not shown) in which the frame component A lies substantially alongside and parallel to its companion frame component B. The provision of a hinge interconnection between the frame components that make up each of the frame assemblies 12–14 allows these frame assemblies, when folded to the stowed position, to be compactly packaged in a minimum volume for shipment and storage prior to sale and installation. Each of the folded frame assemblies 12–14, once removed from a package, can be immediately unfolded to assume the open position shown in FIGS. 1 and 3, so that the mitered joint J of professional appearance is formed without requiring cutting or assembly by the installer.

Figure 2:
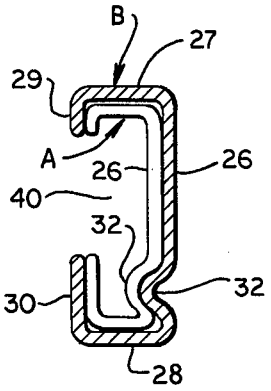
FIG. 2 is a section view taken along line 2—2 of FIG. 1, showing the telescopic interconnection of two frame assemblies.

Each of the frame components A and B which make up the frame assemblies 12–14 takes the shape of a semiclosed channel, as best seen in FIG. 2, having a back wall 26, a pair of side walls 27 and 28 extending outwardly at substantially a right angle to the back wall, and a pair of flanges 29 and 30 extending inwardly from the respective side walls 27 and 28 to terminate in confronting spaced-apart relation to each other. As particularly seen in FIG. 2, the flange 30 is longer than the flange 29; the longer flange 30 on each of the frame components A and B is nearer to the opening 31 (FIG. 1) defined by the frame 10, and so the flange 30 is hereafter known as the "inner flange". Similarly, the relatively short flange 29 is hereafter known as the "outer flange".

It is apparent from FIG. 2 that the frame component A of the frame assembly 14 fits telescopically within the frame component B of the frame assembly 12, and to that end the overall dimensions of those frame assemblies are selected to provide a smoothly telescoping fit of the two frame components. The frame components A and B which make up each of the frame assemblies 12–14 may preferably be fabricated from extrusions of a metal such as aluminum or the like, although it will also be understood that the frame components may be made of nonmetallic materials. Each of the frame components in the disclosed embodiment has a ridge 32 deformed inwardly into the semiclosed channel from the back wall 26; the ridges 26 mate with each other as shown in FIG. 2 to assist in the smooth telescopic sliding alignment of the mating frame components A and B.

Returning to FIG. 1, it is seen that the telescopic interconnection of frame components detailed in FIG. 2 is repeated for each frame component of the frame assemblies 12–14. Each of the frame components A and B, as well as the individual frame members 15 and 16, is in the shape of a semiclosed channel as shown in FIG. 2, and each of the foregoing members may have either a relatively large overall configuration (typified by the size of frame component B in FIG. 2) or a relatively small overall configuration (typified by frame component A in FIG. 2) to permit telescopic interconnection. Thus, the frame components A and B of the frame assemblies 13 and 14 are each relatively small, so that the frame component B of frame assembly 13 telescopically fits within the frame component A of frame assembly 12. Each of the individual frame members 15 and 16, in the disclosed embodiment, is relatively large, to enable those frame members to fit telescopically over the relatively small frame components B and A of the respective frame assemblies 14 and 13. Thus, the frame components of the frame assemblies 12–14, and the frame members 15 and 16, telescopically fit together to define the rectangular frame 10 that may be independently adjusted either in length or in width, within limits defined by the lengths of the individual frame components and frame members. Each of the frame members 15 and 16 terminates in a beveled end 35 and 36, respectively, which abut each other to form the mitered joint J', shown in phantom in FIG. 1.

A storm window frame 10 according to the present invention may be installed on an existing window 11 in the following manner. The two frame assemblies 12 and 13 which comprise the upper portion of the frame 10 are opened along their hinge interconnections 23 to assume the right-angle positions shown in FIGS. 1 or 3, and the frame component B of frame assembly 13 is telescopically inserted within the frame component A of frame assembly 12. The two frame assemblies 12 and 13 are telescopically adjusted so that the vertically depending frame components A (of frame assembly 13) and B (of frame assembly 12) lie on the frame of the existing window 11, substantially parallel and in alignment with the edge of that existing window. The frame assemblies 12 and 13 may need to be positioned a short distance above the opening of the existing window 11, to clear any existing hardware that may be present on the casing of the existing window. The frame assemblies 12 and 13 are now secured to the existing window casing by inserting screws or other suitable fasteners through holes, such as the holes 22 shown in FIG. 3, formed at suitable intervals along the back wall 26 of each frame component. There will preferably be at least one such hole near each beveled end which makes up the mitered joints J, and other such holes spaced approximately ten inches apart along the length of the frame components and frame members. As seen in FIG. 3, the holes 22 may be off-center along the width of the frame components, to allow easy access by a screwdriver or the like through the opening between the outer flange 29 and inner flange 30 of unequal length.

Once the frame assemblies 12 and 13 are secured in place, the frame member 15 is telescopically disposed over the frame component B of the frame assembly 14, and the frame component A of that frame assembly is telescopically inserted in the frame component B of the frame assembly 12. The frame member 16 is also telescopically fitted over the frame component A of the frame assembly 13 at this time. The two frame members 15, 16 and the frame assembly 14 are telescopically adjusted relative to each other, so that the bottom of the frame 10 (comprised of the frame member 15 and frame component B of the frame assembly 14) rests on the windowsill 38 of the existing window 11. The two separate frame members 15 and 16 are initially telescoped inwardly from the join J' as shown in solid line, FIG. 1, to and in assembling the frame members, after which the two separate frame members are telescoped outwardly to meet each other at the joint J'. The frame assembly 14 and the frame members 15, 16 are now secured to the casement of the existing window 11 by fasteners such as screws or the like, in the manner described above.

Inasmuch as a tight draft-free fit of the frame 10 against the casement of the existing window 11 is desirable, the back wall 26 of each frame component and frame member, as well as the side wall 28 of the members making up the bottom of the frame 10, may be equipped with suitable weatherstripping (not shown) to insure an airtight seal with the existing window. Alternatively, the casement-contacting surfaces of the frame 10 can be provided with a bead of caulking compound applied from a conventional source such as a caulking gun, in a manner known to those skilled in the art, to provide an airtight seal between the frame 10 and the existing window.

Figure 4:
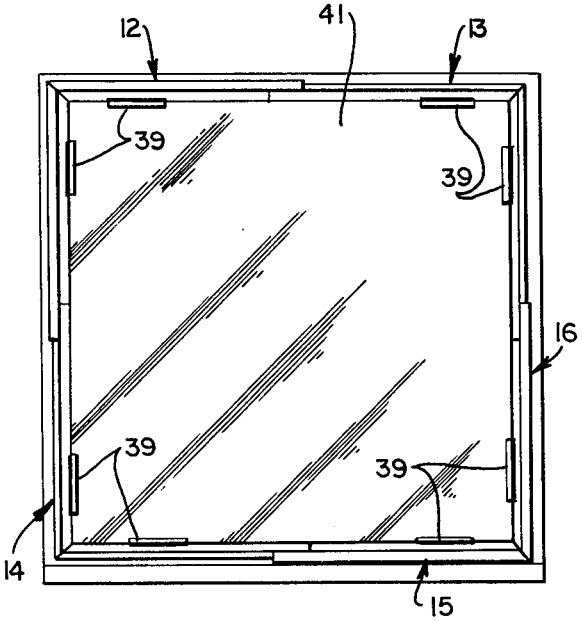
FIG. 4 is an overall elevation view of the frame apparatus shown in FIG. 1, with a sheet of transparent plastic material installed on the frame.

Installation of the storm window frame 10 is now completed, and a sheet 41 of suitable material such as clear vinyl or the like, shown in FIG. 4, can now be stretched across the opening 31 defined by that frame. The edges of the plastic sheet are wrapped around the end of the inner flange 30, on each of the frame components and frame members, and a number of suitable clamps 39 are fitted over the free edge of the inner flange 30 to secure the edge of the plastic sheet in place. The free end of the plastic sheet lies within the interior 40 of the semi-closed channel, and it will thus be seen that the plastic sheet need not be cut to the exact dimension of the frame opening 31 prior to securing the sheet to the frame. Installation of the storm window frame 10 is completed, and the frame 10 with its attached plastic sheet provides a relatively inexpensive and lightweight storm window which effectively provides an airtight seal over the existing window 11.

The frame assemblies and frame members, along with the screws or other fasteners necessary for installation, and a quantity of plastic sheet material for the maximum available frame opening can be supplied as a kit for installation by anyone having only modest mechanical skills, since no metal-cutting or other forming operations are required. The kit may optionally include a decorative cover for the semi-open channels of the frame components and frame members, to enhance the ornamental appearance of the installed storm window frame. Although the frame assemblies and frame members of a kit could be sized to form a frame 10 adjustable to fit a range of popular-size windows, extra frame members having the necessary cross-section dimensions to telescopically interconnect existing members of the standard frame assembly can be sold to accommodate outsize existing windows.

It will be apparent that the frame structure 10 is not limited to use as a storm window, but can alternatively be used to provide window screens over an existing window. The frame for use with screening is constructed and installed identically as described above, after which a sheet of suitable window screening material is installed on the frame in place of the plastic sheet which makes up the storm window.

Although the foregoing description indicates that the frame members and frame assemblies are attached to the existing window frame by screws or like fasteners, it should be understood that other fastening techniques may laternatively be employed with window frames according to the present invention. For example, the frames can be semipermanently attached by means of magnetic inserts disposed within the interiors 40 of the several members, where the frame 10 is attached to an existing window frame or other building component made of steel. Such magnetic mounting allows the frame to be removed intact from the existing window when desirable, for example, during mild or warm weather. Further yet, the storm window frame structure can be configured to fit inside the frame opening of the exiting window, when provided with appropriate clamps which hold the telescopic frame components and frame members in an expanded position which engages the existing window frame to hold the frame 10 in place.

Although the adjustable frame apparatrus is here described with reference to windows, this frame apparatus is not limited to that particular application. For example, frame apparatus according to the present invention may provide a temporary shelter or covering for goods stored in the open air; the fram assemblies, possibly including extra frame members to expand overall frame size, could be interconnected to provide a frame skeleton for covering with a suitable weatherproof material such as plastic sheet.

It will be understood that the foregoing relates only to a particuolar embodiment of the present invention, and that numerous changes and modifications may be made therein without departing from the spirit and the scope of the invention as defined in the following claims.

I claim:

1. Adjustable frame apparatus for attachment in surrounding relation with an existing opening such as a window or the like, comprising:

a first assembly having a pair of elongated frame members mutually interconnected to form an included right angle;

a second assembly separate from said first assembly and having a pair of elongated frame members mutually interconnected to form an included right angle, one of said frame members of said second assembly being selectably and adjustably connectable to one of said frame members of said first assembly;

a third assembly having a pair of elongated frame members mutually separate from said first and second assemblies and interconnected to form an included right angle, one of said frame members of said third assembly being selectably and adjustably connectable to the other said frame member of said first assembly;

said pair of elongated frame members in each of said assemblies being interconnected by means which enable said paired arms to fold from said right angle position to be substantially alongside each other, when the frame members making up the assembly are disconnected from another frame member;

a first separate frame member selectably and adjustably connectable to the other said frame member of said second assembly;

a second separate frame member selectably and adjustably connectable to the other said frame member of said second assembly;

each of said selectable and adjustable interconnections of said frame members comprising a telescopic sliding interconnection between said frame members; and each of said sliding interconnections being selectably slidable independently of the other sliding interconnections so that said assemblies and frame members selectably and adjustably interconnect to form a rectangular frame which is independently adjustable in length and width;

each of said frame members comprising a channel member having a channel closed on three sides and having a partially open fourth side; and said partially open side of each channel facing outwardly from the frame formed by said frame members, and defining a flange located near the opening defined by said frame, so as to provide means for securing a web to said frame.

2. Apparatus as in claim 1, wherein:

said partially open side of each channel is defined by a pair of flanges of unequal width;

the wider of said flanges being said flange located near the opening defined by said frame, so as to provide means for securing a web to said frame; and each of said channel members having complementary mating means operative to permit said telescopic sliding interconnection of frame members in one way only, so as to prevent improper telescopic interconnection of the frame members.

3. Apparatus as in claim 1, wherein each of said selectable and adjustable interconnections of said frame members comprises a telescopic interconnection between the channel members which make up said frame members.

* * * * *